United States Patent [19]

Holtmann

[11] 4,328,959

[45] May 11, 1982

[54] METHOD AND DEVICE FOR REMOVING USED REFRACTORY LINING AND/OR SLAG DEPOSITS FROM ELONGATED VESSELS

[76] Inventor: Gerwin Holtmann, Fürst-Bismarck-Str. 9, 4100 Duisburg 13, Fed. Rep. of Germany

[21] Appl. No.: 208,054

[22] Filed: Nov. 14, 1980

[51] Int. Cl.[3] ..... F27D 23/02

[52] U.S. Cl. ..... 266/281; 266/135; 266/287

[58] Field of Search ..... 266/135, 44, 280, 281, 266/287

[56] References Cited

U.S. PATENT DOCUMENTS 4,151,982 5/1979 Herz ..... 266/287 X

FOREIGN PATENT DOCUMENTS 2821229 11/1979 Fed. Rep. of Germany ..... 266/281
1488843 10/1977 United Kingdom ..... 266/287
388842 11/1973 U.S.S.R. ..... 266/281
519476 8/1976 U.S.S.R. ..... 266/281
530055 11/1976 U.S.S.R. ..... 266/281

*Primary Examiner*—G. O. Peters
*Attorney, Agent, or Firm*—McGlew and Tuttle

[57] ABSTRACT

An apparatus and method for removing used refractory lining or slag or both from the inner wall of an elongated vessel. The apparatus includes a cutting disc movably mounted on a guide mechanism which may be fixably located within the vessel. In accordance with the inventive technique, one or more recesses is formed within the lining extending from the surface thereof to the wall of the vessel.

7 Claims, 4 Drawing Figures

METHOD AND DEVICE FOR REMOVING USED REFRACTORY LINING AND/OR SLAG DEPOSITS FROM ELONGATED VESSELS

FIELD AND BACKGROUND OF THE INVENTION

The invention relates in general to refractory linings of elongated vessels, and more particularly, to a new and useful method and apparatus for removing used refractory linings or slag deposits or both from elongated vessels, particularly pig-iron cars and mixers.

In the metallurgical technology, elongated vessels provided with a refractory lining are employed for various purposes. A used refractory lining, or the slag which might have deposited thereon, must be periodically removed and a new lining provided. This operation, in most instances, is manually performed with power-operated break-away tools. This conventional method is not totally satisfactory since it requires great physical effort and, primarily, is hazardous to health, because the work must be done in relatively narrow confinement and results in a production of large amounts of dust so that inhalation by the workers is unavoidable. Accordingly, such work by a single person must be restricted to a very short period of time, with frequent reliefs in service, resulting in high labor costs.

The prior art method is unsatisfactory not only in labor economy, but also in the economy of plant operation.

The laborious breaking away of the lining material, which frequently is a mixture of hard slag and brick fragments, takes much time during which the vessels, such as pig-iron cars, also known as torpedo cars, mixers, or blast furnace cowper stoves, for example, are out of service.

Many attempts have been made to improve this practice. For example, to mechanize the removal of slag and lining from pit furnaces West German patent 15 58 560 discloses special break-away machines. Special devices have also been designed for breaking away the lining of blast furnaces, for example, see West German patent 15 33 840. However, devices of this kind or similar ones cannot be used in very narrow, elongated vessels which have difficult accessibility, or their use causes inadequate expenses.

SUMMARY OF THE INVENTION

The invention is directed to a method, and a special device suitable therefor, which facilitates, simplifies, and speeds the removal of used refractory linings or slag deposits or both from elongated vessels such as pit-iron cars or mixers. The invention is premised on the fact that refractory lining in cool state is under high compressive stress which is effective in the circumferential direction and builds up primarily as the shell of the vessel cools down since the lining, having a different coefficient of expansion, does not contract to the same extend as the shell.

The invention starts from the idea of facilitating the removal of the refractor lining by dealing with this compressive stress first, namely by using the inventive measures and means for removing this stress, and only then proceeding to the removal of the refractory lining.

In accordance with the invention, a method of removing used refractory lining from the inner wall of an elongated vessel, particularly pig-iron cars and mixers, using an apparatus of the type having cutting means operable to cut one or more recesses in the refractory lining, guide means for longitudinally guiding the cutting means centrally along the interior of the vessel, and expander means connected to the guide means operable to contact one of the refractory lining and the wall and fixably locate the guide means in the vessel comprises the steps of locating the guide means within the vessel, operating the expander means to fixably locate the guide means and actuating the cutting means to cut one or more recesses in the refractory lining extending from the surface of the lining to the wall of the vessel.

By cutting or milling the recesses into the refractory lining over the entire length thereof, the compressive stress present therein is reduced or completely removed. Since the surface zone of the used-up lining is always stronglyworn down and in most instances also mechanically damaged, the notches and cracks caused by wear are enlarged by the stress removal. Then, only a light attack with breaking tools or periodic mechanical concussions are usually needed to effect further loosening and dislodging of the lining material to be removed.

In accordance with another method feature of the invention, the concussions augmenting the dislodgement of the material after pressure or stress removal are produced by pneumatically or hydraulically operated vibrators acting on the vessel. With vertically extending vessels, the concussions may be produced in accordance with the invention by vibrators inserted into the cut recesses in their upper portion or applied on the lining to be removed.

In another varient of the method applicable to elongated rotary vessels, the concussions may be produced by continually rotating the vessel in one direction or alternately in opposite directions.

Depending on the size or diameter of the vessel, it may be advantageous to cut into the lining to be removed two or more uninterrupted recesses extending along the entire wall of the vessel. This may still be more efficient for relieving the compressive stress in the lining. It is further advisable to cut the recesses alongside each other, spaced apart by a distance of about 50 to 250 mm, depending on the given conditions.

According to still another variation of the inventive technique, the two recesses extending parallel to each other may be provided at opposite locations on the interior of the vessel. This may be advantageous primarily in vertically extending, upright vessels. With larger diameters of the vessels, it is advantageous to cut a plurality of recesses, extending parallel in the longitudinal direction of the vessel, and distributed at spaced locations over the circumference of the vessel.

A further variant of the inventive method provides that in vessels which are provided with an entry or manhole in the central zone, at least one radially extending recess is cut in this zone into the lining to be removed. In such a case, even two or more radially extending recesses may be cut into the lining and the material between the recesses can then be broken away by means of power-operated tools. This is a particularly effective way of loosening and relieving stress in the lining of larger-sized vessels. Further, the lining between two cut recesses may be divided by means of power tools into smaller panels, to more effectively loosen and relieve the stress in the lining.

Applying the inventive method quite considerably facilitates and simplifies the removal of used refractory lining from elongated vessels, particularly if they are narrow. In all instances, the hitherto purely manual work is substantially facilitated and the workers are relieved to a considerable extent of physical effort and danger. Health hazards due to dust development are also remarkably reduced, especially because the sojourn of the working teams can be shortened quite extraordinarily. Further, the new method is by far more economical than the prior art methods, since it requires much less labor and does not put the vessels representing a high investment out of service for such a long time as before.

In accordance with the invention, an apparatus for removing used refractory lining from the walls of an elongated vessel, particularly pig-iron cars and mixers, includes cutting means for cutting one or more recesses in the refractory lining extending from the surface of the lining to the wall of the vessel, guide means such as a guide mechanism locatable within the vessel for longitudinally guiding the cutting means centrally along the interior of the vessel and expander members connected to the guide means operable to extensably contact one of the refractory lining end wall and apply a pressure thereto to fixably locate the guide means. Due to the guide mechanism which can be secured in position within the vessel by means of expanders, manual work for producing the longitudinal slots or recesses is substantially eliminated since the tools are guided in the longitudinal direction and mechanically adjusted to keep to a uniform cutting depth.

Another feature of the inventive apparatus is that the cutting device may be equipped with a corrundum-or-diamond-tipped cutting disc, or that two such power-operated discs may be provided side by side.

Further features of the invention relates to the guide mechanism for the cutting devices. The expanders may be operated pneumatically or hydraulically and the mechanism may be provided with guide members for two oppositely mounted carriers of cutting or milling devices or break-away tools; with larger vessels, guide mechanisms for three or more cutting or milling devices or break-away tools may be provided, of course. In addition, the guide mechanism may be equipped with a sliding carriage on which one or more of the devices or tools are mounted for pivoting and for being fixed in such positions that two or more parallel slots or recesses can be cut in succession.

The invention further provides that the guide mechanism comprises a power drive for advance elements which are intended to effect the traveling motion of the carriers of the cutting or milling devices. This design makes it possible, upon adjusting the guide mechanism within the vessel, to cut the recesses completely automatically, without any manual intervention, so that accidents or health risks are completely avoided.

Accordingly, it is an object of the invention to provide a simple and quick method of removing used refractory lining from the inner wall of an elongated vessel and an apparatus for carrying out the method which is simple in design, rugged in construction and economical to manufacture.

The method is illustrated and one embodiment of the invention is shown in the accompanying drawings with the following description applied to an elongated pig-iron vessel, a so-called topedo car, for track-bound crude iron transporation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
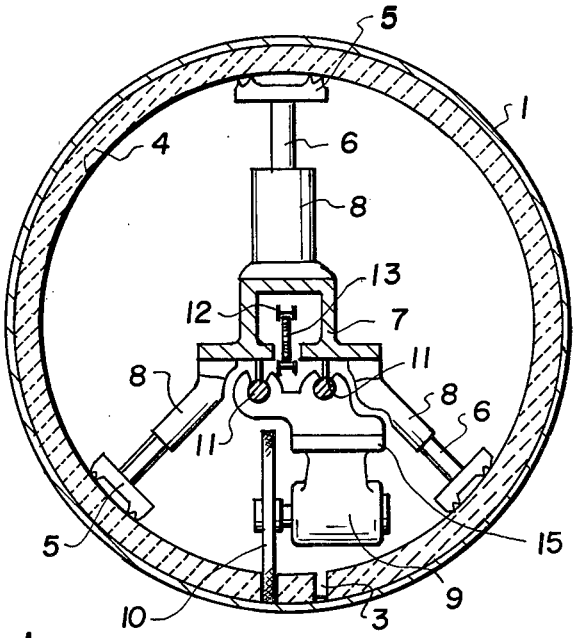
FIG. 1 is a cross-section of a cylindrical vessel containing an apparatus in accordance with a first embodiment of the invention, schematically illustrated.
Figure 2:
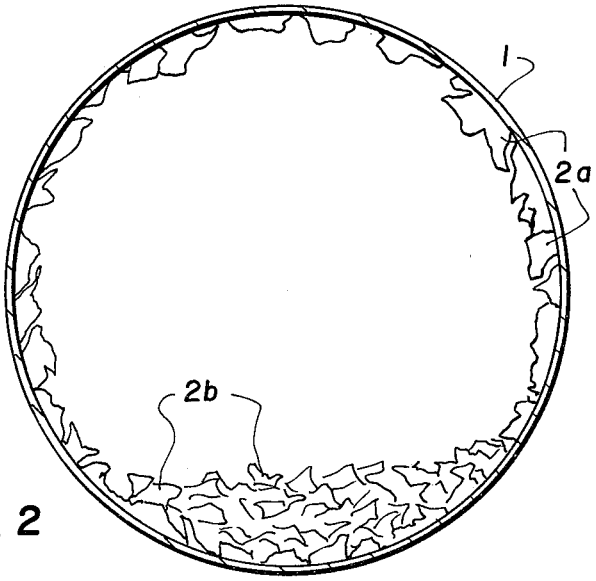
FIG. 2 is a schematic illustration of a vessel in which a portion of the refractory lining has been removed in accordance with the invention.

Referring now to the drawings in particular, there is shown various embodiments of an apparatus for removing used refractory lining 2 from the wall 1 of an elongated vessel.

In the figures, the cylindrical vessel wall is indicated at 1 and the refractory lining to be removed, at 2. As shown in FIG. 1, two adjacent parallel recesses are cut into lining 2, of which one is designated 3. The provided cutting device is a milling disc 10 with a drive 9. The cutting device 9, 10 is secured to a carriage 15 sliding in the longitudinal direction on guide rods 11. Guide rods 11 are suspended from a guide mechanism 7. Guide mechanism 7 is rigidly fixed in place centrally of vessel 1 by means of extensible expanders 8.

To extend and apply them against the lining, expanders 8 may be pressure-fluid operated. In the embodiment of FIG. 1, however, only the upwardly extending expander 8 is pressure fluid operated, more particularly, by compressed air. The other two expanders 8 extending obliquely downwardly are adjustable and fixable mechanically. Such a design is satisfactory for vessels of certain size in which the inside diameter or clearance within the the lining surface 4 varies only slightly. Expander rods 6 are provided on their ends with claws 5 which gain hold on the lining surface 4.

Guide mechanism 7 is equipped with a drive (not shown) for advance elements comprising a driving chain 12 and associated sprocket wheels 13.

Upon cutting the recesses 3, guide mechanism 7 with cutting device 9, 10 is withdrawn from vessel 1. Then by means of a drive provided on the torpedo car (not shown), the vessel is put into a continuous rotary motion. This continuously displaces the deflection line of the vessel, and the elastic deformation of the vessel shell resulting therefrom causes the lining 2, relieved of stress to further fragmentize and disintergrate to individually crumbled segments 2*a* which become dislodged from the lining and accumulate on the vessel bottom. During further rotation, material 2*b* accumulated on the bottom produces an intense mechanical grinding effect on the still firmly adhering parts 2*a* of the lining which are, thereby, further loosened and dislodged. Experience has shown that time period of one-half hour to a few hours is sufficient to loosen and dislodge the old lining completely so that it accumulates on the bottom in the form of fragments which can easily be removed from the vessel.

Figure 3:
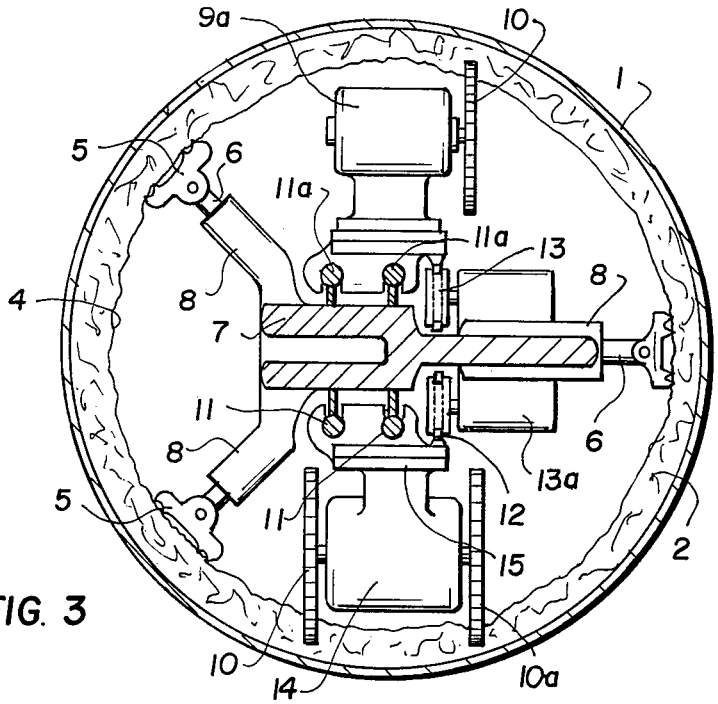
FIG. 3 is a cross-section of a cylindrical vessel with a refractory lining on its inner wall schematically illustrating the inventive apparatus in accordance with a second embodiment.

FIG. 3 illustrates another embodiment of guide mechanism 7. In this design, three expanders 8 are again provided which bear, by their expander rods 6 and claws 5, against the inner surface 4 of vessel lining 2. Claws 5 are connected to rods 6 by a movable joint.

In this embodiment, guide mechanism 7 is provided with two oppositely disposed milling devices which are mounted for travel along guide rods 11. The milling devices maybe equipped each with a single milling disc 10, as shown in FIG. 1 or in the upper part of FIG. 3 at 9*a*, or with two milling discs 10, 10*a* as the cutting device 14 shown the lower part of FIG. 3. It is further possible, as depicted in FIG. 3, to mount a cutting device 9*a* for swiveling, so that two parallel recesses may be sequentially cut by milling disc 10*a*.

As further follows from FIG. 3 separate advance mechanisms 12, 13 with drive motors 13*a*, which may comprise guiding chain members, are provided for each of the two cutting devices 9*a*, 14.

Figure 4:
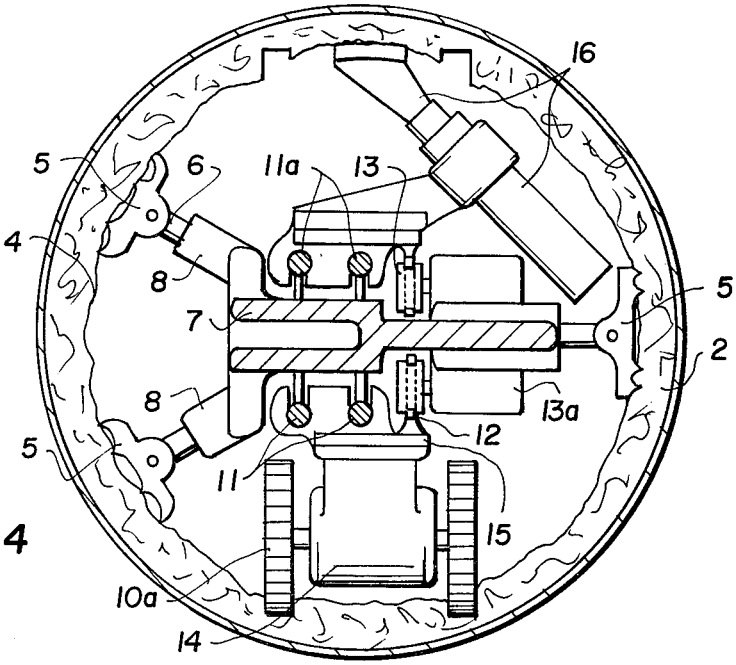
FIG. 4 is a cross-section of a cylindrical vessel having an inner refractory lining and illustrating an arrangement of a third embodiment of an apparatus for removing the refractory lining in accordance with the invention.

According to FIG. 4, the device may be equipped with two milling cutters 10*a* and, in addition, with a break-away tool 16 which, in the shown embodiment, is provided with a spade-or spoon-like removing tool. The break-away tool may also be mounted for pivoting (not shown).

These devices make it possible to perform the cutting and milling and, if necessary, the breaking work too, in elongated narrow vessels where virtually no escape is possible in cases of emergency, automatically and thus without any manual aid, so that upon adjusting the mechanism, the working team can withdraw from the vessel prior to starting the cutting and milling work. As compared to the hitherto practiced methods, this ensures a maximum safety and speed.

While specific embodiments of the invention have been shown and described in detail to illustrate the application of the principles of the invention, it will be understood that the invention may be embodied otherwise without departing from such principles.

What is claimed is:

1. A method of removing used refactory lining from the inner wall of an elongated vessel, particularly pig-iron cars and mixers, using an apparatus of the type having cutting means operable to cut one or more recesses in the refractory lining, guide means for longitudinally guiding said cutting means centrally along the interior of the vessel and expander means connected to the guide means operable to contact one of the refractory lining and wall and fixably locate the guide means in the vessel, comprising the steps of locating the guide means within the vessel, operating the expander means to fixedly locate the guide means, actuating the cutting means to cut one or more recesses in the refractory lining extending from the surface of the lining to the wall of the vessel, and further comprising continuously rotating the vessel in one direction.

2. A method of removing used refractory lining from the inner wall of an elongated vessel, particularly pig-iron cars and mixers, using an apparatus of the type having cutting means operable to cut one or more recesses in the refractory lining, guide means for longitudinally guiding said cutting means centrally along the interior of the vessel, and expander means connected to the guide means operable to contact one of the refractory lining and wall and fixably locate the guide means in the vessel, comprising the steps of locating the guide means within the vessel, operating the expander means to fixedly locate the guide means, actuating the cutting means to cut one or more recesses in the refractory lining extending from the surface of the lining to the wall of the vessel, and further comprising alternately rotating the vessel in opposite directions.

3. A method as set forth in claim 1 or 2, wherein the apparatus has power-operated break-away tool means for striking the refractory lining further comprising the step of operating the break-away tool means to strike the refractory lining adjacent to one or more of the recesses.

4. A method as set forth in claim 1 or 2 comprising cutting a plurality of spaced recesses and subjecting the lining between the spaced recesses to vibrations.

5. A method of removing used refractory lining from the inner wall of an elongated cylindrical vessel, particularly pig-iron cars and mixers, comprising the steps of cutting a plurality of spaced recesses in the refractory lining extending from the surface of the lining of the wall of the vessel, then mechanically stressing the lining between said recesses, and further comprising continuously rotating the vessel in one direction.

6. A method of removing used refractory lining from the inner wall of an elongated cylindrical vessel, particularly pig-iron cars and mixers, comprising the steps of cutting a plurality of spaced recesses in the refractory lining extending from the surface of the lining of the wall of the vessel, then mechanically stressing the lining between said recesses, and further comprising alternately rotating the vessel in opposite directions.

7. A method of removing a used refractory lining or slag deposits or both from the walls of elongated vessels, particularly pig-iron cars and mixers, comprising the steps of initially cutting one or more recesses along the wall of the vessel to a depth such as to reach the vessel wall by means of a power operated cutting or milling device traveling and guided alongside the vessel, and then exposing the material which is still present between these recesses and has not been loosened as a result of the relieved stress and pressure to periodic concussions by means of vibrators acting on the vessel, thereby loosening the material and breaking it away.

* * * * *